US010461415B2

(12) United States Patent
Hefele et al.

(10) Patent No.: US 10,461,415 B2
(45) Date of Patent: Oct. 29, 2019

(54) BROADBAND OMNIDIRECTIONAL ANTENNA

(71) Applicant: KATHREIN-WERKE KG, Rosenheim (DE)

(72) Inventors: Tanja Hefele, Waakirchen (DE); Andreas Plötz, Chieming (DE)

(73) Assignee: Kathrein SE, Rosenheim (DE)

( * ) Notice: Subject to any disclaimer, the term of this patent is extended or adjusted under 35 U.S.C. 154(b) by 0 days.

(21) Appl. No.: 15/881,087

(22) Filed: Jan. 26, 2018

(65) Prior Publication Data

US 2018/0219282 A1 Aug. 2, 2018

(30) Foreign Application Priority Data

Jan. 27, 2017 (DE) ..... 10 2017 101 677

(51) Int. Cl.

| | |
|---|---|
| ***H01Q 9/40*** | (2006.01) |
| ***H01Q 1/52*** | (2006.01) |
| ***H01Q 1/42*** | (2006.01) |
| *H01Q 1/00* | (2006.01) |

(52) U.S. Cl.

CPC ..... *H01Q 1/521* (2013.01); *H01Q 1/42* (2013.01); *H01Q 9/40* (2013.01); *H01Q 1/007* (2013.01)

(58) Field of Classification Search

CPC ..... H01G 9/0421; H01G 1/243

See application file for complete search history.

(56) References Cited

U.S. PATENT DOCUMENTS

| | | | | |
|---|---|---|---|---|
| 2005/0134511 | A1* | 6/2005 | Haunberger | H01Q 1/40 343/725 |
| 2013/0009834 | A1* | 1/2013 | Hefele | H01Q 9/32 343/770 |
| 2016/0226145 | A1* | 8/2016 | Xu | H01Q 9/28 |
| 2017/0025750 | A1* | 1/2017 | Su | H01Q 1/36 |

FOREIGN PATENT DOCUMENTS

| | | | |
|---|---|---|---|
| CA | 2 825 003 | 8/2012 | |
| DE | 103 59 605 | 7/2005 | |
| EP | 2154752 A1 * | 2/2010 | H01Q 1/007 |

* cited by examiner

*Primary Examiner* — Dameon E Levi
*Assistant Examiner* — David E Lotter
(74) *Attorney, Agent, or Firm* — Nixon & Vanderhye P.C.

(57) ABSTRACT

A broadband omnidirectional antenna comprises a first radiator which is galvanically isolated from a base plate and extends away therefrom. The first radiator has a first end comprising a foot and/or feed-in point and a second end which is opposite the first end, and radiator surfaces which originate in the region of the first end and extend towards the second end. A second radiator comprises at least one radiator surface, the second radiator being arranged on the first radiator so as to be galvanically isolated therefrom. It is possible for said second radiator to be fed exclusively by the first radiator. The radiator surfaces of the second radiator are arranged as a continuation of the first radiator or the at least one radiator surface of the second radiator is arranged in the region of the second end of the first radiator so as to be in parallel with the base plate.

21 Claims, 11 Drawing Sheets

BROADBAND OMNIDIRECTIONAL ANTENNA

CROSS-REFERENCE TO RELATED APPLICATION

Priority is claimed from German Patent Application No. 10 2017 101 677.5 filed Jan. 27, 2017, the entire contents of which is incorporated herein by reference for all purposes.

FIELD

The invention relates to a broadband omnidirectional antenna.

BACKGROUND AND SUMMARY

Omnidirectional antennas are used for example as indoor antennas. They are multiband capable and preferably radiate with a vertical polarisation orientation. For this purpose, they may comprise a base or earth plate (reflector), which may for example be disc-shaped and on which a monopole radiator rises transversely and in particular perpendicularly to the base plate. The entire arrangement is generally covered by a protective housing, i.e. an antenna cover (radome).

The present broadband omnidirectional antenna can not only be used within buildings, but for example also in vehicles, in particular rail vehicles or boats.

A generic omnidirectional antenna is known for example from DE 103 59 605 A1. The monopole radiator known from this document rises vertically above a base plate, from which it is galvanically isolated. The antenna known from this document comprises a vertically polarised monopole radiator. In this case, the vertically polarised radiator is in particular in the shape of a hollow cylinder or hollow cone and extends away from the base plate.

The omnidirectional antenna from DE 103 59 605 A1 is disadvantageous in that the lower limiting frequency is limited by the specified overall height and the specified diameter.

The example non-limiting technology provides a broadband omnidirectional antenna which can be produced so as to be as simple, cost-effective and compact as possible, and which at the same time covers a wider frequency spectrum.

This is achieved by means of a broadband omnidirectional antenna as described herein.

A broadband omnidirectional antenna comprises a first radiator that is arranged on a base plate, which base plate is preferably also used as a reflector, and that has a longitudinal axis which extends at least approximately, predominantly or completely perpendicularly to the base plate. In that case, the first radiator extends from the base plate away therefrom. The first radiator has a first end comprising a foot and/or feed-in point and a second end which is opposite the first end. The first end, i.e. the foot and/or feed-in point, of the first radiator is in this case galvanically isolated from the base plate, but is arranged closer to the base plate than the second end. The first radiator also comprises radiator surfaces which originate in the region of the first end and extend towards the second end. A distance between the radiator surfaces and the longitudinal axis increases at least in portions from the first end towards the second end. This means that the radiator surfaces diverge from one another along the longitudinal axis at least over a partial length. Furthermore, the omnidirectional antenna comprises a second radiator which comprises at least one radiator surface. The second radiator is arranged on the first radiator so as to be galvanically isolated therefrom and can be fed preferably exclusively or predominantly by the first radiator. In one embodiment, the radiator surfaces of the second radiator are arranged in relation to the radiator surfaces of the first radiator such that they can act as a continuation thereof. This means that the second radiator is a continuation of the first radiator. In this case, the radiator surfaces of the second radiator can be inclined at least in portions or can only extend in parallel with the longitudinal axis. They are spaced further apart from the base plate than the radiator surfaces of the first radiator. Alternatively, i.e. in another embodiment, it would also be possible for the at least one radiator surface of the second radiator to be arranged in the region of the second end of the first radiator, in particular between the radiator surfaces of the first radiator, i.e. within said radiator, so as to be in parallel with the base plate or such that one of the components thereof is predominantly parallel to said base plate.

It is particularly advantageous for the second radiator to be fed exclusively or predominantly by the first radiator. In this case, a separate feed line for the second radiator is not required or provided. In this case, it is advantageous for the second radiator to be a continuation of the first radiator, the two radiators being galvanically isolated from one another. This increases the band width that can be produced and keeps the production costs low.

In an advantageous embodiment of the broadband omnidirectional antenna, a feed device is arranged at the foot and/or feed-in point. In this case, the feed device extends towards the base plate and preferably passes therethrough. A connector element, in particular in the form of a socket, is arranged on a bottom side of the base plate, which side is opposite the assembly side comprising the received first and second radiators. A feed cable can be or is connected to said connector element. The feed device preferably extends, at least by its first end, into the connector element, it being possible for electrical contact to be established, or said electrical contact being established, at least indirectly (via an additional conductor) or directly, between the first end of the feed device and an internal conductor of the feed cable. In this case, the feed device is galvanically isolated from the base plate. Depending on the embodiment of the broadband omnidirectional antenna, the feed device is galvanically, but preferably in a solder-free manner, connected to the first radiator at the foot and/or feed-in point. The feed device could also be capacitively coupled to the first radiator at the foot and/or feed-in point, the feed device extending towards the second end of the radiator surfaces of the first radiator at least in part along the longitudinal axis or such that one of its components is predominantly in parallel with the longitudinal axis.

In this case, it is particularly advantageous for the foot and/or feed-in point of the first radiator to have a sleeve-shaped or hollow cylindrical extension towards the second end of the first radiator. The feed device is arranged in the sleeve-shaped extension at least over a partial length thereof, the feed device and the sleeve-shaped extension being galvanically isolated from one another. The sleeve-shaped extension can extend as far as the second end of the first radiator or beyond the second end of the first radiator. Depending on the use, the first radiator can thus be fed capacitively or inductively.

In a particularly preferred embodiment, the first radiator has, along its longitudinal axis and over its entire length or a partial length thereof, a progression that is in part or predominantly or completely conical or funnel-shaped. The second radiator comprises a predominantly or preferably completely peripheral radiator surface, a diameter or circumference of the peripheral radiator surface of the second radiator at the first end thereof being adapted to a diameter or circumference of the second end of the first radiator.

Adaptation of this kind is preferably achieved by the diameter or circumference at the first end of the second radiator deviating from the diameter or circumference at the second end of the first radiator by less than 20%, 15%, 10%, 8%, 5% or 3%. It is particularly advantageous for the diameter or circumference at the first end of the second radiator to be slightly larger than the diameter or circumference at the second end of the first radiator. "Slightly larger" should be understood to mean larger by a small number of millimeters, in particular by less than 8 mm, 6 mm, 4 mm or 2 mm, but preferably by more than 1 mm, 3 mm, 5 mm, 7 mm or 9 mm.

In the context of another embodiment, the diameter of the second radiator remains constant along the longitudinal axis or decreases in the direction of the longitudinal axis from the first end towards the second end. This is particularly advantageous in that the omnidirectional antenna can be constructed so as to be compact.

In another preferred embodiment of the omnidirectional antenna, the second radiator comprises one or more slots, which extend from the second end thereof, which is opposite the first end, towards said first end and terminate at a distance therefrom. In this case, the width of these slots can be constant or decrease towards the first end. In principle, the first slots could also extend from the first end towards the second end and terminate at a distance from the second end.

So that the first radiator and the second radiator are permanently oriented relative to one another in a precisely defined position, in a particularly preferred embodiment of the omnidirectional antenna, a (dielectric) holding and/or spacing element is used which is arranged at least in part within the first radiator and is non-rotatably fastened thereto. The holding and/or spacing element is preferably also non-rotatably fastened to the second radiator, the holding and/or spacing element being designed such that a gap (along the longitudinal axis) between the first end of the second radiator and the second end of the first radiator has an adjustable width. The first radiator and the second radiator are therefore arranged in relation to one another such that they do not overlap. The holding and/or spacing element therefore performs a number of functions. Firstly, the holding and/or spacing element prevents the first radiator and the second radiator from rotating relative to one another over time. Furthermore, said element ensures that the first radiator and the second radiator are galvanically isolated from one another. The gap, which is adjusted between the first radiator and the second radiator by the holding and/or spacing element, is preferably larger than 0.1 mm, 0.3 mm, 0.5 mm, 0.7 mm, 0.9 mm, 12 mm, 15 mm, 17 mm, 20 mm, 30 mm, 40 mm or 50 mm, and is preferably smaller than 40 mm, 30 mm, 20 mm, 18 mm, 16 mm, 13 mm, 11 mm, 9 mm, 8 mm, 6 mm, 3 mm or 1 mm.

In another preferred embodiment, the first radiator comprises n radiator surfaces, where $n \geq 2$. In this case, the n radiator surfaces are galvanically interconnected or formed in one piece with one another at the first end of the first radiator, the radiator surfaces being arranged around the longitudinal axis of the first radiator so as to be offset from one another, thus forming slots between adjacent radiator surfaces, and the slots beginning at a distance from the first end of the first radiator and extending as far as the second end of the first radiator. In this case, at least part of the at least one radiator surface of the second radiator is arranged at the second end of the first radiator, between the radiator surfaces of the first radiator, so as to be in parallel with the base plate or such that one of the components thereof is predominantly in parallel with said plate. What is particularly advantageous here is that a radiator arrangement of this kind can be produced in a very simple manner, for example from sheet metal parts. An omnidirectional antenna of this kind has a very low overall height, but still operates at a wide range of frequencies.

In another embodiment, the radiator surfaces of the first radiator comprise a plurality of radiator partial surfaces which are oriented at an angle to one another. The same can also apply to the at least one radiator surface of the second radiator.

In this case, the radiator surfaces of the first radiator and second radiator are preferably free of curves (except for the bending edge) and are each arranged in a separate plane. In this case, the first radiator and/or the second radiator can be produced from a metal sheet in a cutting, stamping and/or bending process.

In a particularly preferred embodiment of the omnidirectional antenna, said antenna comprises a coupling device. The coupling device is used in order for it to be possible for the lower limiting frequency at which the omnidirectional antenna can be operated to be reduced further. For this purpose, the coupling device comprises one or more coupling projections, a first end of the coupling projection or coupling projections being galvanically connected to the radiator surface of the second radiator and extending towards the base plate. The coupling projection or coupling projections is/are spaced further apart from the longitudinal axis than the radiator surfaces of the first radiator and second radiator. This means that the coupling projection or coupling projections extend towards the base plate outside of the first radiator and second radiator. At least one coupling surface is formed or integrally formed on a second end of the coupling projection or coupling projections that is opposite the first end and is therefore arranged closer to the base plate than said first end, which coupling surface is galvanically connected to the relevant coupling projection. The at least one coupling surface extends in parallel with the base plate or such that one of the components thereof is (predominantly) in parallel with said plate. Owing to coupling of this kind that is relative to the base plate, the lower limiting frequency can be reduced further. In this case, it is possible for the omnidirectional antenna to be operated in a frequency range of 600 MHz to 6 GHz. Said antenna is preferably operated in a frequency range of 650 MHz or 698 MHz to 6 GHz. Depending on the size and dimensions of the feed point, inter alia, it is also possible for the frequency range to be widened at the upper and/or lower limit.

In another embodiment of the omnidirectional antenna, the at least one coupling surface is galvanically connected to the base plate or is arranged at a distance therefrom such that the at least one coupling surface is capacitively coupled to the base plate. The distance between the coupling surface and the base plate and the size of the coupling surface can be varied as desired, depending on the use. The coupling surface can be arranged so as to be in parallel with the base plate. It can also be arranged obliquely or designed so as to be uneven (e.g. undulating).

In this case, an additional dielectric can be arranged between the at least one coupling surface and the base plate, for example, on which dielectric the at least one coupling surface rests or is supported. As a result, the coupling can again be adjusted more accurately and the stability of the omnidirectional antenna as a whole can be increased.

In another preferred embodiment, the plurality of coupling projections are galvanically connected to a common coupling surface by means of the second end thereof, the coupling surface being in the form of a common coupling frame which defines a receiving space in which part of the first radiator is arranged. In principle, the common coupling frame can be of any shape. In particular, the cross section thereof may be rectangular, square, circular or oval.

In order to further increase the stability of the omnidirectional antenna and further increase weather resistance, in another embodiment, said antenna comprises a covering hood. Preferably, one single covering hood is used, which is connected to the base plate in an interlocking and/or frictional and optionally moisture-tight manner, and surrounds the first radiator and second radiator. In this case, the covering hood is preferably arranged such that it is not in contact with the first radiator and the second radiator.

BRIEF DESCRIPTION OF THE DRAWINGS

Various embodiments are described in the following by way of example and with reference to the drawings. Like items have like reference numerals. Specifically, in the corresponding figures of the drawings.

Figure 3:
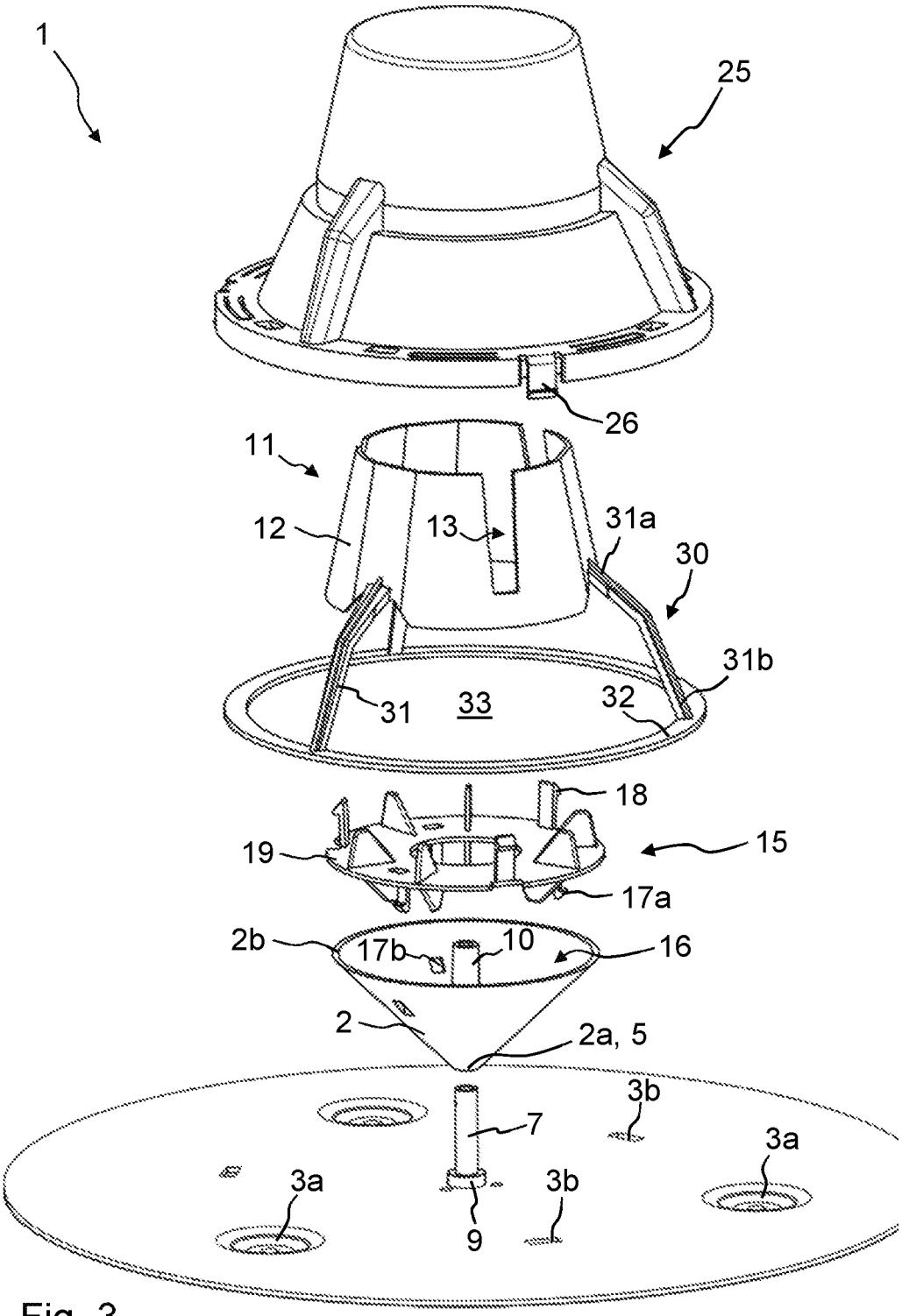
Figure 5:
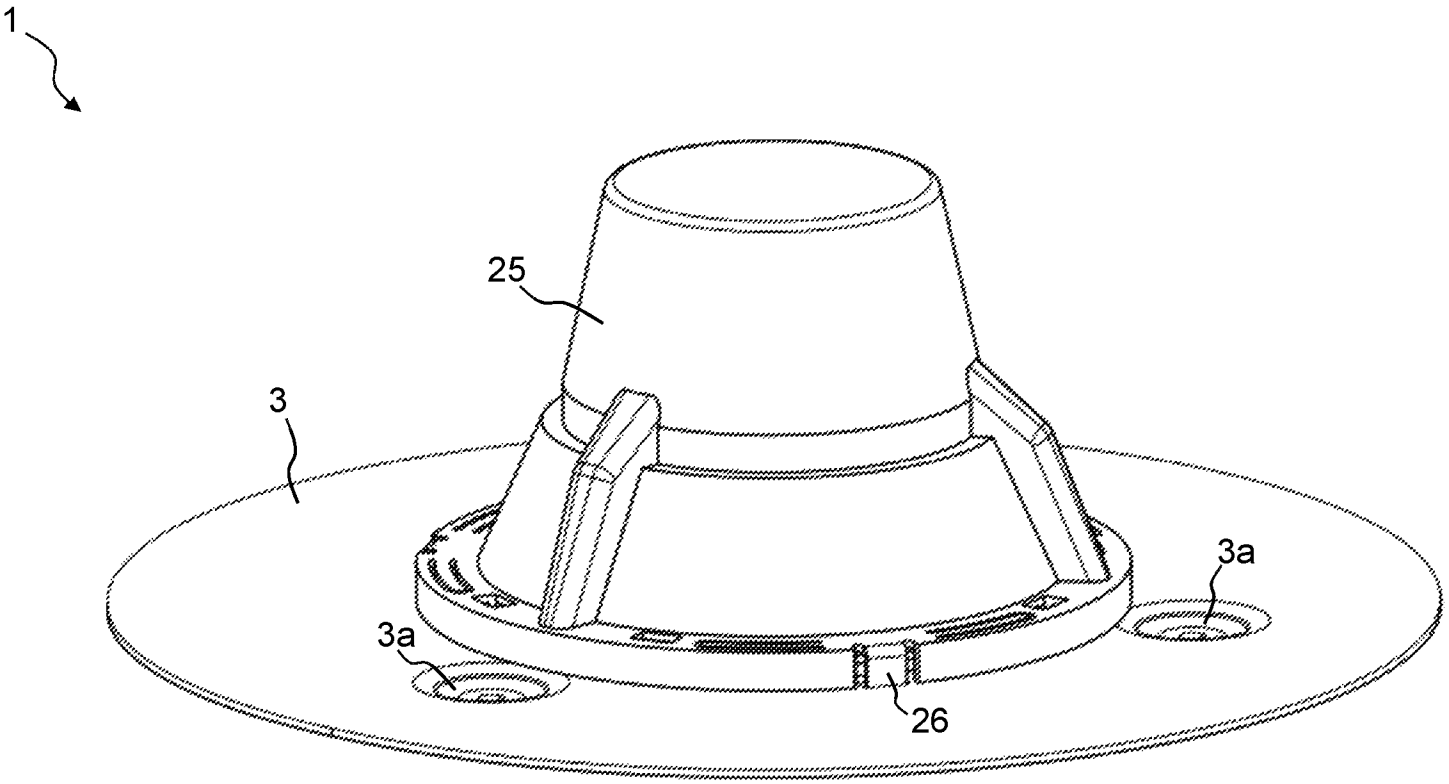
Figure 6:
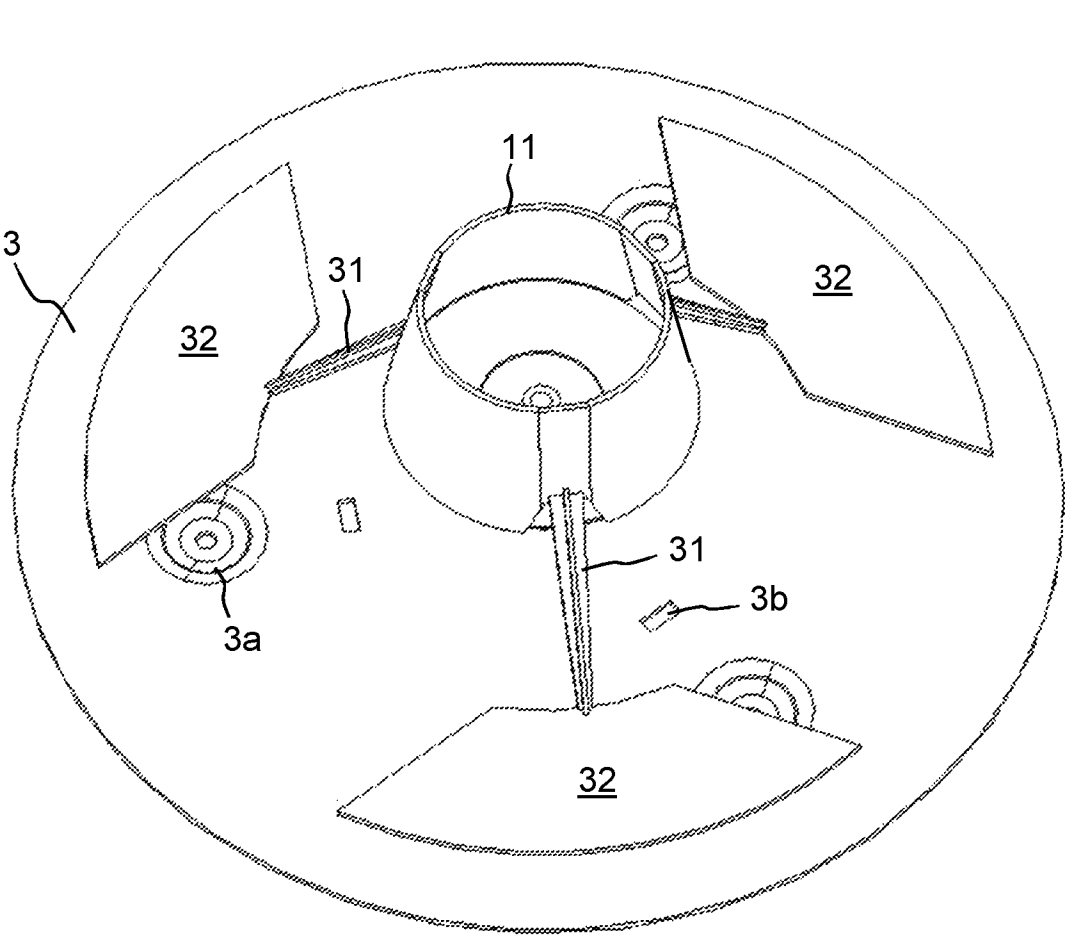
Figure 8:
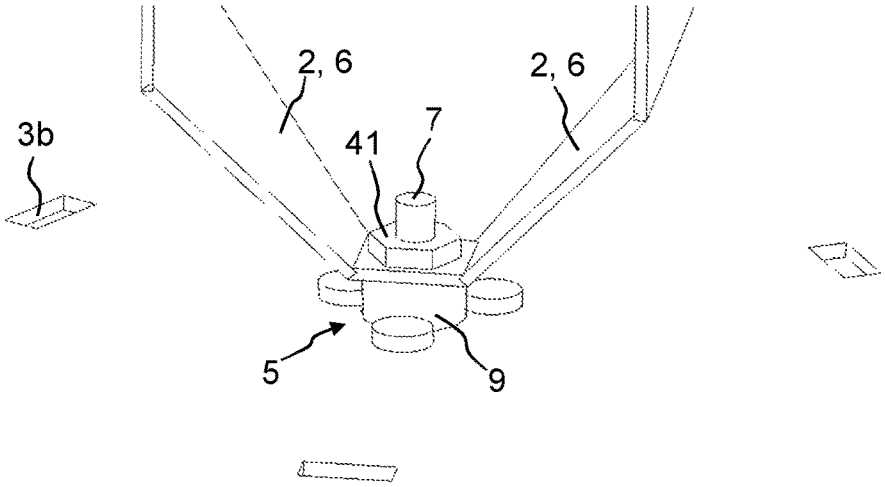
Figure 9A:
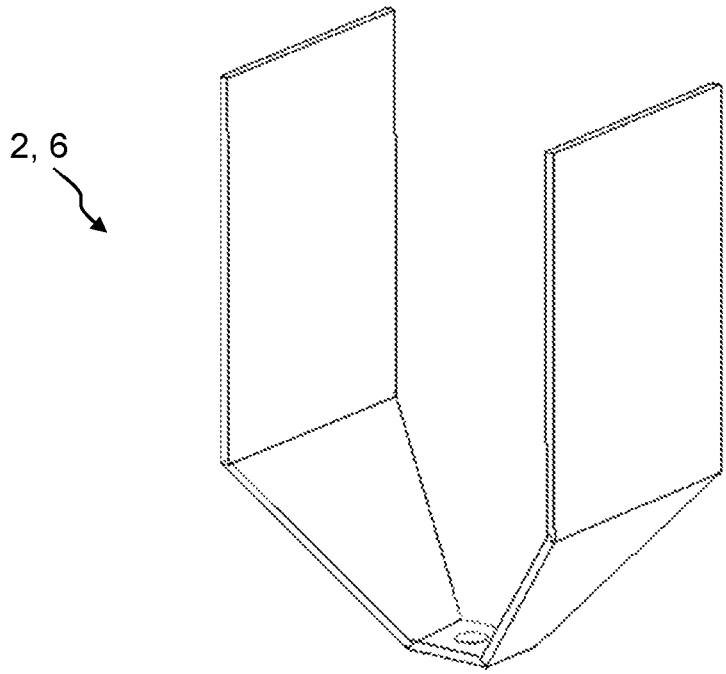
Figure 9B:
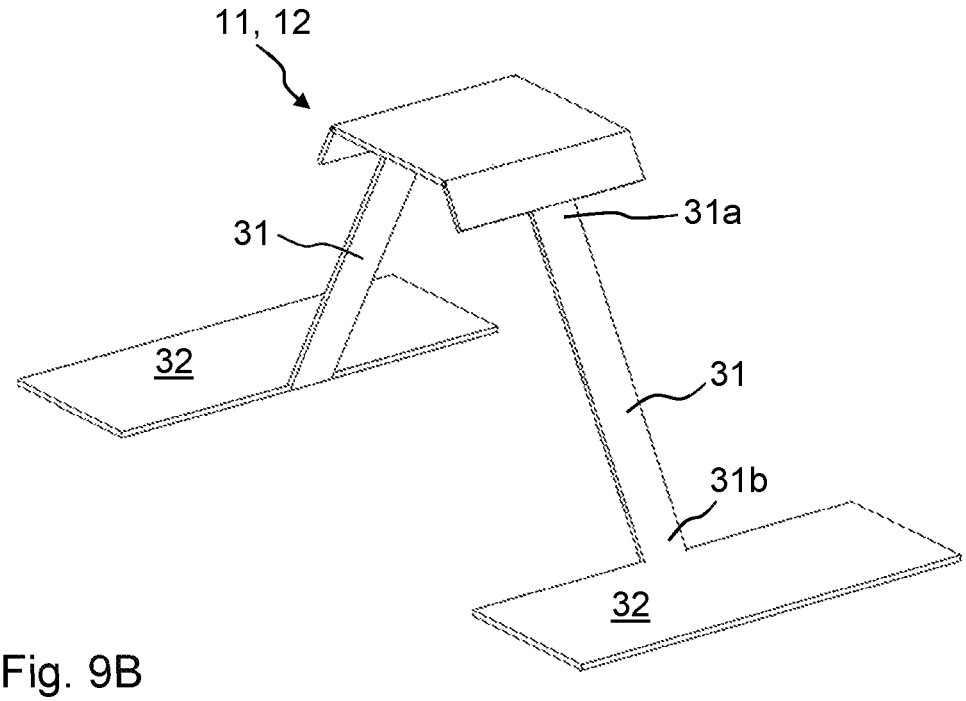

show a first embodiment of the omnidirectional antenna;

FIG. 3 is an exploded view of the omnidirectional antenna in accordance with the first embodiment;

FIG. 4A to 4C:

are sectional views of the omnidirectional antenna in accordance with the first embodiment;

FIGS. 5 and 6:

are spatial views of the omnidirectional antenna in accordance with the first embodiment;

FIG. 7A to 7C:

are various views of the omnidirectional antenna in accordance with a second embodiment;

FIG. 8: is a spatial view of the foot and/or feed-in point of the omnidirectional antenna in accordance with the second embodiment; and FIGS. 9A and 9B:

are various spatial views of a first radiator and a second radiator of the omnidirectional antenna in accordance with the second embodiment.

DETAILED DESCRIPTION OF NON-LIMITING EXAMPLE EMBODIMENTS

Figure 1:
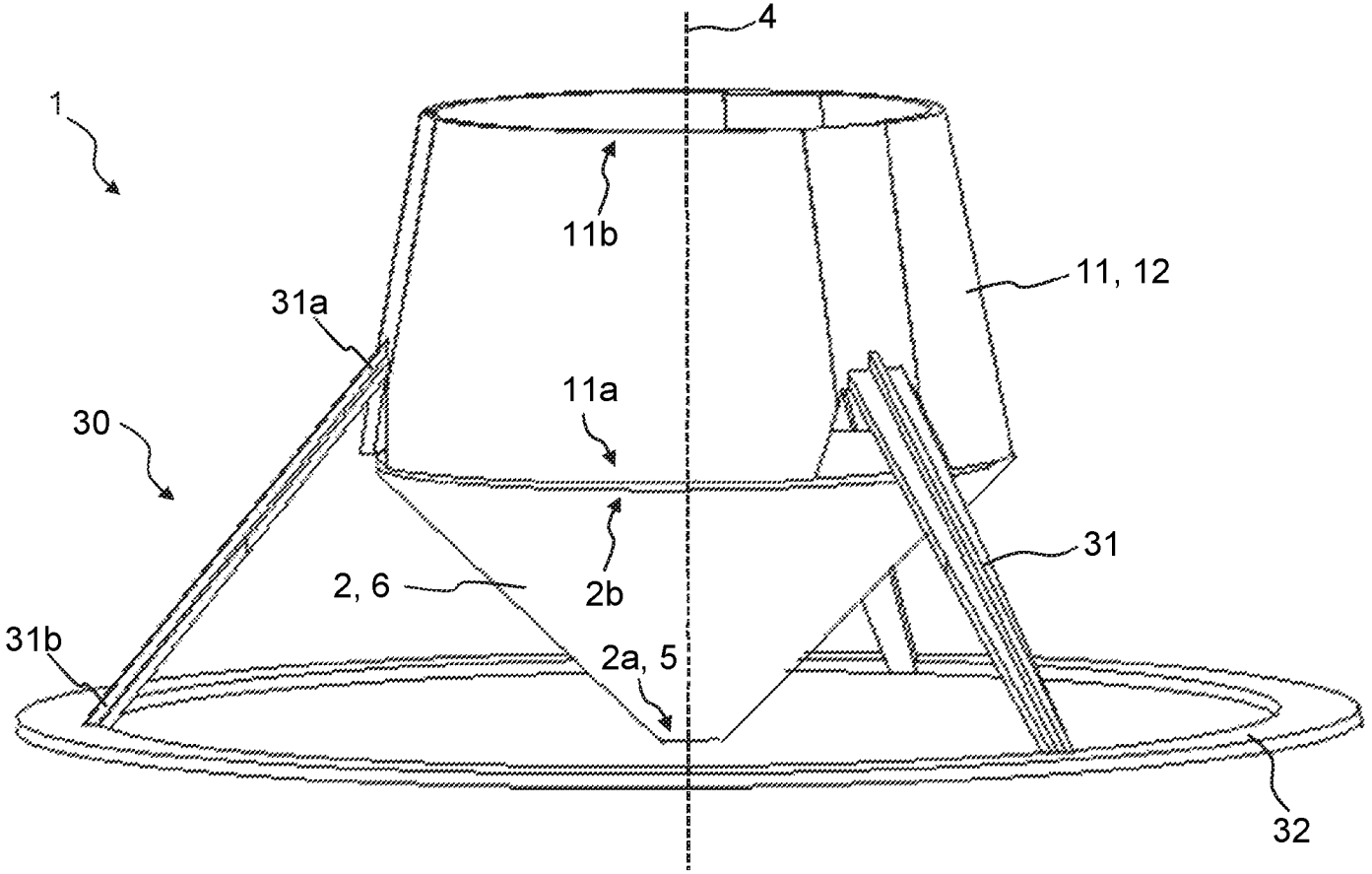
FIGS. 1 and 2.
Figure 2:
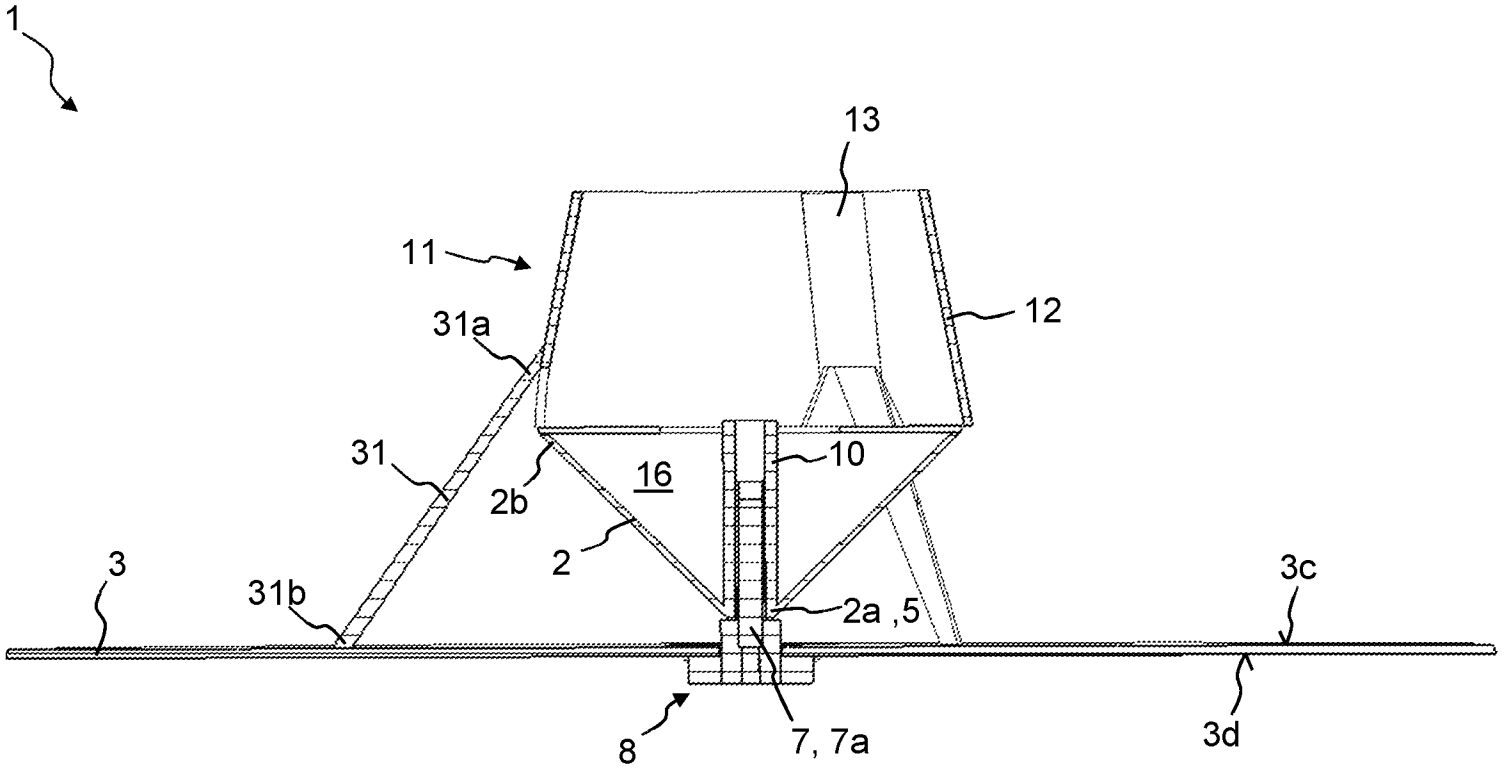

FIGS. 1 and 2 show a first embodiment of the omnidirectional antenna 1. FIG. 3 is an exploded view of the first embodiment of the omnidirectional antenna 1. The omnidirectional antenna 1 operates at a very wide range of frequencies, in particular in a frequency range of 600 MHz, 650 MHZ or 694 MHz to 6000 MHz. Said antenna comprises a first radiator 2 which is galvanically isolated from a base plate 3 and extends away therefrom, the first radiator 2 having a longitudinal axis 4 which extends at least approximately perpendicularly to the base plate 3. The base plate 3 may also be referred to as a reflector. The base plate 3 consists of an electrically conductive material, such as a metal. Said base plate could also consist of a dielectric material and be provided with an electrically conductive layer. The base plate 3 comprises a plurality of recesses 3*a* by means of which the base plate 3 can be connected to a support located therebelow. The base plate 3 also functions as a counterweight surface in order to support the rest of the omnidirectional antenna 1.

The first radiator 2 has a first end 2*a* and a second end 2*b* which is opposite the first end 2*a*. The first end 2*a* can also be considered to be a foot and/or feed-in point 5. In this case, the first end 2*a* is arranged closer to the base plate 3 than the second end 2*b*. The first radiator 2 comprises radiator surfaces 6 which originate in the region of the first end 2*a* and extend towards the second end 2*b* or form said second end 2*b*. A distance between the radiator surfaces 6 and the longitudinal axis 4 increases at least in portions from the first end 2*a* towards the second end 2*b*.

In the first embodiment of the omnidirectional antenna 1, the first radiator 2 has, along its longitudinal axis 4, a completely conical or funnel-shaped progression. It could also progress only in part or predominantly in the manner of a cone or funnel. It would also be possible for the first radiator 2 to have in its cross section, i.e. transversely to the longitudinal axis 4, a partial circumferential region which is partially circular, another partial circumferential region consisting of a straight line or a plurality of straight lines that extend at an angle to one another.

The gradient of the conical or funnel-shaped progression does not have to be constant, but rather can also change. In this case, portions having a larger gradient can be connected to portions having a smaller gradient. A change of this kind can occur several times.

In the embodiment shown, there is only one radiator surface 6 of the first radiator 2 or the radiator surfaces 6 of the first radiator 2 are preferably interconnected in a seamless manner or transition into one another in a seamless manner.

FIGS. 2 and 3 show the feeding of the first radiator 2. A feed device 7 is arranged at the foot and/or feed-in point 5 of the first radiator 2. The feed device 7 can preferably be pin-shaped. A connector element 8, in particular in the form of a socket, is arranged on a bottom side 3*d* of the base plate 3, which side is opposite the assembly side 3*c* comprising the received first radiator 2. A feed cable (not shown) can be connected to said connector element 8.

The feed device 7 extends towards the base plate 3 and can also pass therethrough. However, this is not compulsory. Advantageously, the feed device 7 instead extends, at least by its first end 7*a*, into the connector element 8, it being possible for electrical contact to be established, at least indirectly, between the first end 7*a* of the feed device 7 and the internal conductor of the feed cable. The feed device 7 can also be considered to be an internal conductor of the connector element 8, for example. "Direct" feeding would also be possible if the feed device 7 were to be screwed or soldered directly to the first radiator 2, in particular to the foot and/or feed-in point 5 thereof. In this case, there is consistently good alignment (e.g. no resonance).

An external conductor of the feed cable can be connected to the base plate 3 by means of the connector element 8 in an electrically conductive manner.

So that the foot and/or feed-in point 5 is connected to the base plate 3 at the first end 2*a* of the first radiator 2 in a non-electrically conductive manner, a sleeve 9 made of a dielectric material is preferably arranged between the foot and/or feed-in point 5 and the base plate 3. In this case, the sleeve 9 can be a component part of the connector element 8. The first radiator 2 is supported on said sleeve 9 by its foot and/or feed-in point 5.

In the embodiments of FIGS. 1 to 3, the feed device 7 is capacitively coupled to the first radiator 2. Coupling occurs at the foot and/or feed-in point 5 of the first radiator 2. The feed device 7 extends towards the second end 2*b* of the radiator surfaces 6 of the first radiator 2 at least in part along the longitudinal axis 4. In order to increase capacitive coupling, the first radiator 2 comprises at the foot and/or feed-in point 5 thereof a sleeve-shaped extension 10 which extends towards the second end 2*b* of the first radiator 2. In this case, the sleeve-shaped extension 10 can terminate before the second end 2*b* of the first radiator 2 or can end so as to be flush with the second end 2*b* of the first radiator 2. Said extension can also extend further in the direction of the longitudinal axis 4 and project beyond the second end 2*b* of the first radiator 2. The sleeve-shaped extension 10 preferably consists of the same material of which the first radiator 2 also consists. This material is preferably a metal, such as aluminium. In principle, the first radiator 2 can also consist of a dielectric which is provided with an electrically conductive layer. In this case, the first radiator 2 can be produced in a casting method, in particular in an (aluminium) die casting method. The feed device 7 and the sleeve-shaped extension 10 are in this case galvanically isolated from one another. In this case, a casing, in the form of an additional sleeve for example, can be placed on the feed device 7, and this ensures that there is galvanic isolation. The feed device 7 can also be coated with a dielectric layer, at least in the region in which it is arranged in the sleeve-shaped extension 10.

The sleeve-shaped extension 10 and the first radiator 2 are preferably formed in one piece, and they therefore consist of a common part. The sleeve-shaped extension 10 could also be integrally formed on the first radiator 2 by means of a solder or weld connection.

The broadband omnidirectional antenna 1 also comprises a second radiator 11 which comprises at least one radiator surface 12. The second radiator 11 is arranged so as to be galvanically isolated from the first radiator 2. The second radiator 11 is preferably fed exclusively by the first radiator 2. A feed cable cannot be directly connected to the second radiator 11. In this case, the second radiator 11 can be produced in a casting method, in particular in an (aluminium) die casting method.

The embodiment in FIGS. 1 to 3 shows that the radiator surfaces 12 of the second radiator 11 are arranged as a continuation of the first radiator 2. The radiator surfaces 12 are preferably inclined at least in portions. In this case, the radiator surfaces 12 are in particular inclined towards the longitudinal axis 4. However, they could also extend exclusively or predominantly in parallel with the longitudinal axis 4.

The radiator surface 12 of the second radiator 11 is preferably peripheral, and therefore it can also be referred to as a radiator lateral surface 12.

The second radiator 11 has a first end 11*a* and a second end 11*b* which is opposite the first end 11*a*. The first end 11*a* is arranged closer to the base plate 3 than the second end 11*b*. This means that the first end 11*a* of the second radiator 11 is arranged closer to the second end 2*b* of the first radiator 2 than the second end 11*b* of the second radiator 11. The radiator surface 12 of the second radiator 11 is preferably completely or predominantly closed in the circumferential direction. Openings can be made, for example, only in order to fasten the second radiator 11 to the first radiator 2 or to the base plate 3.

A diameter of the peripheral radiator surface 12 of the second radiator 11 at the first end 11*a* thereof is adapted to a diameter of the second end 2*b* of the first radiator 2. The diameter at the first end 11*a* of the second radiator 11 is different from or equal to the diameter at the second end 2*b* of the first radiator 2.

In this case, the diameter of the second radiator 11 at the first end 11*a* thereof is larger than, smaller than or equal to the diameter of the first radiator 2 at the second end 2*b* thereof.

The second radiator 11 is preferably in the shape of a hollow cylinder, the diameter decreasing or remaining constant along the longitudinal axis 4. For the case in which the diameter decreases, the diameter is smaller at the second end 11*b* than at the first end 11*a*. The diameter could, however, also increase towards the second end 11*b*. It would also be possible for there to be portions in which the diameter changes. However, the diameter can also change in a constant manner over the entire length of the second radiator 11. The cross-sectional shape may be, but does not have to be, rotationally symmetrical. In this case, the cross section of the second radiator 11 can have individual partial segments which are circular or partially circular, whereas other segments are straight or consist of a plurality of straight lines which converge at an angle.

The second radiator 11 preferably extends along the longitudinal axis 4 over a longer length than the first radiator 2. This situation could also be reversed, however. The two radiators 2, 11 can also extend along the longitudinal axis 4 over the same length.

The second radiator 11 comprises one or more slots 13, which extend from the second end 11*b* towards the first end 11*a* and terminate at a distance therefrom. These slots 13 are shown in FIG. 3. In this case, the width of the slots 13 can be constant over the length thereof. It can also change, however. The slots 13 extend along the longitudinal axis 14 over a length that is preferably longer than 30%, 40%, 50%, 60%, 70% or 80% of the length of the second radiator 11.

If a plurality of slots 13 are provided, they can be formed so as to be symmetrical on the second radiator 11. This means that the distance between individual slots 13 is the same in each case. An asymmetrical arrangement would also be possible. In this case, the distance from one or all of the slots 13 to the adjacent slots 13 in each case would be different.

The slots 13 can be of any shape. They can also be curved or consist of a plurality of slot segments which extend at an angle to one another. The corners can also be rounded.

So that the second radiator 11 is arranged at a precisely defined distance from the first radiator 2, the omnidirectional antenna 1 also comprises a holding and/or spacing element 15. Said holding and/or spacing element 15 preferably consists of a dielectric material, such as a plastics material. The holding and/or spacing element 15 is preferably inserted into the receiving space 16 which is delimited by the radiator surfaces 6 of the first radiator 2. In this case, the holding and/or spacing element 15 is preferably non-rotatably fastened to the first radiator 2. For this purpose, the holding and/or spacing element 15 preferably comprises a plurality of first clip connections 17*a* which engage in a plurality of first fastening openings 17*b* within the first radiator 2. The holding and/or spacing element 15 also comprises a plurality of second clip connections 18 which engage in a plurality of fastening openings in the second radiator 11. Additionally or alternatively, this plurality of second clip connections 18 can also engage in the plurality of slots 13 in the second radiator 11, as a result of which the holding and/or spacing element 15 is non-rotatably connected to the first radiator and second radiator 2, 11. The plurality of first or second clip connections 17*a*, 18 can be introduced into the corresponding fastening openings 17*b* or slots 13 such that the second radiator 11 can only be fastened to the first radiator 2 in a particular rotational or angular position. The holding and/or spacing element 15 also comprises a spacing surface 19 which is preferably designed as a circular surface which is oriented in parallel with the base plate 3 or such that one of the components thereof is predominantly in parallel with said plate. Said spacing surface 19 is preferably put on the second end 2*b* of the first radiator 2 by an end face. The thickness of said spacing surface 19 determines how great the distance is between the first radiator 2 and the second radiator 11.

The holding and/or spacing element 15 comprises an opening at least in the centre thereof, which opening the sleeve-shaped extension 10 of the first radiator 2 can penetrate, for example.

The holding and/or spacing element 15 is preferably formed in one piece. When the omnidirectional antenna 1 is assembled, the holding and/or spacing element 15 is located predominantly within the first and/or second radiator 2, 11. The holding and/or spacing element 15 is preferably only fastened to the first radiator 2 and to the second radiator 11. Said element is preferably not fastened in any other way, in particular to the base plate 3.

Figure 4A:
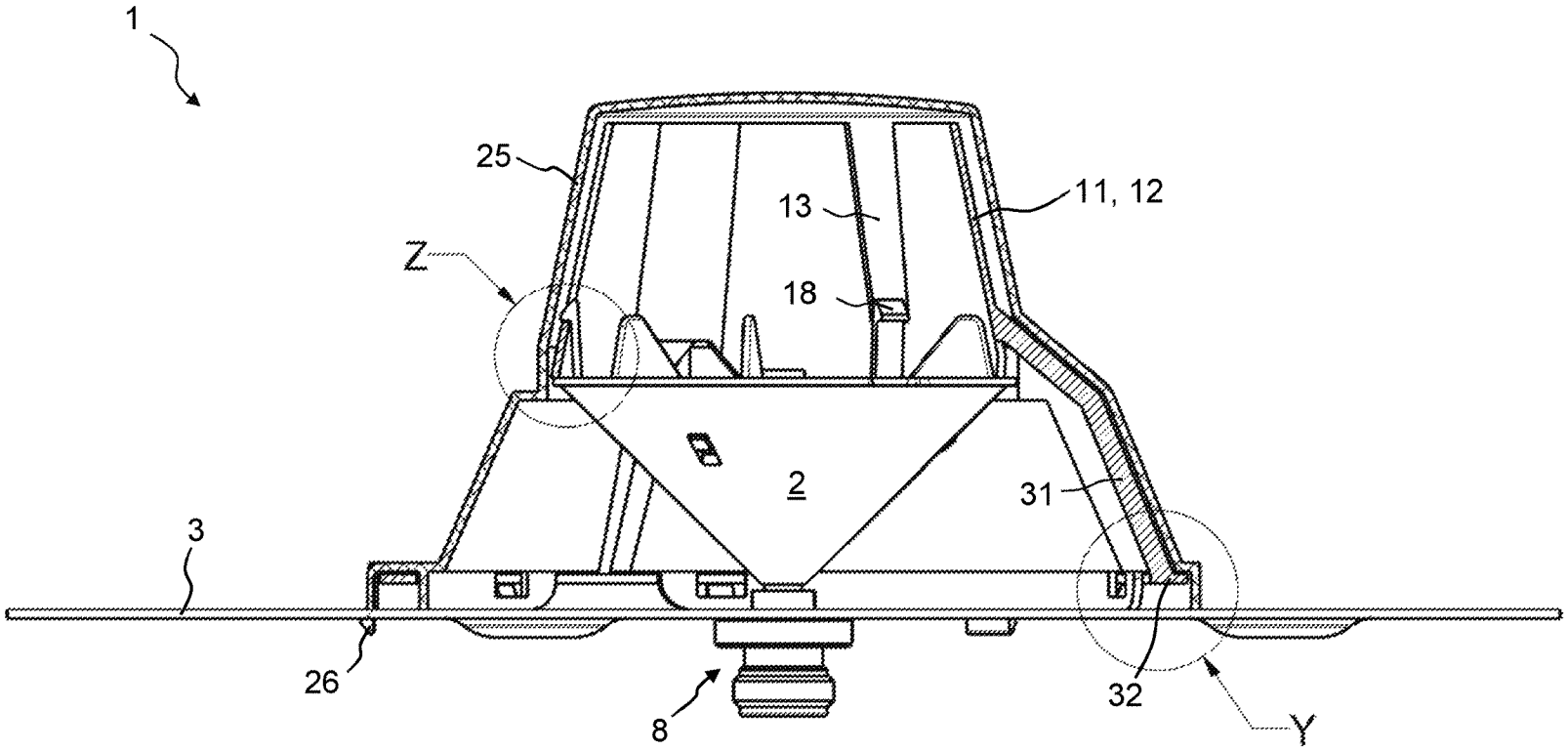
Figure 4B:
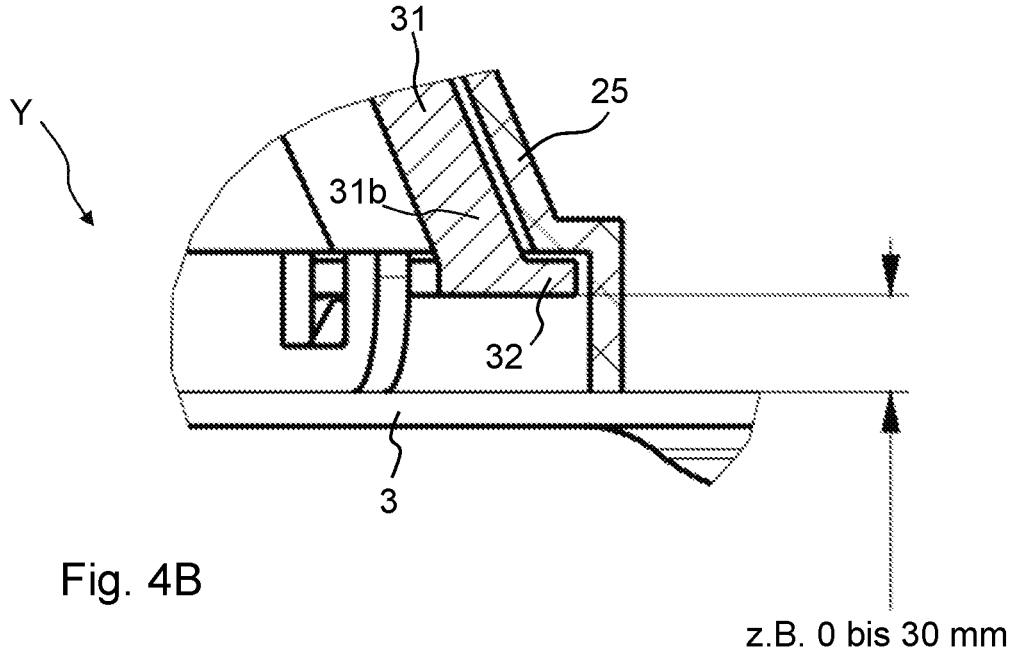
Figure 4C:
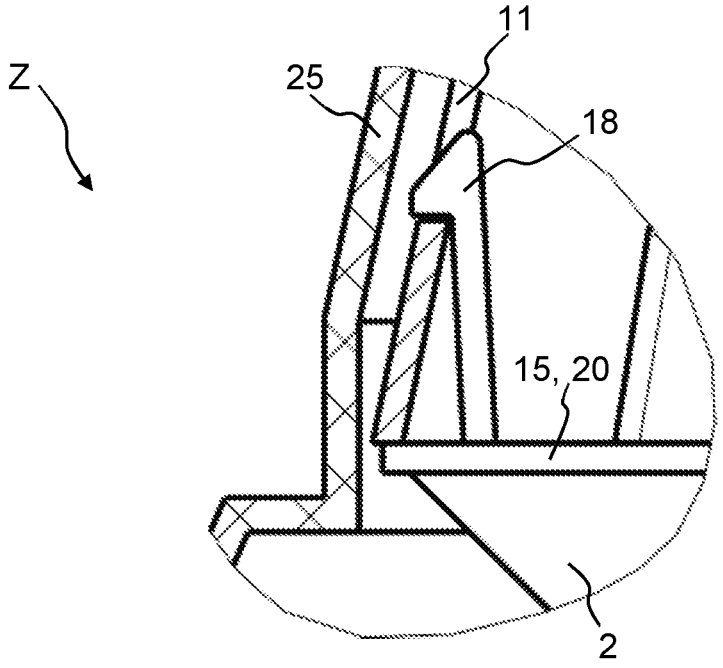

FIG. 4A is a longitudinal section through the omnidirectional antenna 1, whereas FIGS. 4B and 4C are enlarged views of two partial regions which are shown in FIG. 4A. In this case, FIG. 4C shows the gap 20 between the first radiator 2 and the second radiator 11. This gap 20 is preferably filled with the holding and/or spacing element 15. It can be seen that the diameter of the second radiator 11 at the first end 11*a* thereof is larger than the diameter of the first radiator 2 at the second end 2*b* thereof.

It is also shown that one of the second clip connections 18 engages in the slot 13 in the second radiator 11.

It is intended that it be possible for the overall omnidirectional antenna 1 to be assembled without using any tools.

FIG. 3 also shows a covering hood 25. The covering hood 25 is connected to the base plate 3 in an interlocking and/or frictional and also preferably moisture-tight manner and surrounds the first radiator and the second radiators 2, 11. The covering hood 25 is also preferably arranged such that it is not in contact with the first radiator and the second radiator 2, 11. A secure connection between the covering hood 25 and the base plate 3 is established by means of additional clip connections 26, which are formed on the bottom side (which faces the base plate 3) of the covering hood 25. For this purpose, the base plate 3 has corresponding fastening openings 3*b*. The additional clip connections 26 engage in said openings. The shape of the covering hood 25 is adapted to the shape of the second radiator 11 and of the first radiator 2. The covering hood 25 consists of a dielectric material. FIG. 5 shows the completely assembled omnidirectional antenna 1. The covering hood 25 is accordingly rigidly fastened to the base plate 3.

Instead of clip connections 17*a*, 18, 26, other connections can also be used which allow for tool-free assembly (e.g. a bayonet mount).

The base plate 3 preferably has a larger diameter than the covering hood 25 at the lower end thereof that faces the base plate 3.

In order to improve the radiation characteristic, in particular at low frequencies, the omnidirectional antenna 1 also comprises a coupling device 30. The coupling device comprises one or more coupling projections 31. At least a first end 31*a* of the coupling projection 31 is galvanically connected to the radiator surface 12 of the second radiator 11 and extends towards the base plate 3. The first end 31*a* of the coupling projection 31 or coupling projections 31 is arranged closer to the first end 11*a* of the second radiator 11 than to the second end 11*b* of the second radiator 11. This situation could also be reversed, however.

The coupling projections 31 can consist of a segment that is inclined in relation to the longitudinal axis 4. There are preferably no branches off said coupling projections. The coupling projection 31 or coupling projections 31 can also consist of a plurality of partial segments which are interconnected at an angle. The coupling projection 31 or coupling projections 31 are preferably produced in one piece. They consist of an electrically conductive material or are provided with an electrically conductive layer. There may be one coupling projection 31, or two, three, four, or more than four coupling projections 31. Said projections can be fastened to the second radiator 11 symmetrically or asymmetrically. In the case of asymmetric fastening, the distance between adjacent coupling projections 31 can be different.

The second end 31*b* of the coupling projection 31 which is arranged closer to the base plate 3 has coupling surfaces 32 which extend in parallel with the base plate 3 or such that one of the components thereof is predominantly in parallel with said plate. In FIG. 3, all of the coupling surfaces 32 of the coupling projections 31 are interconnected and therefore form a common coupling frame 32. Said frame defines a receiving space 33 in which part of the first radiator 2 is arranged. The common coupling frame 32 has a cross section which is in the shape of a (hollow) circle. Other cross-sectional shapes are also conceivable. A dielectric can be arranged between the at least one coupling surface 32 (e.g. coupling frame) and the base plate 3, on which dielectric the at least one coupling surface 32 rests or is supported. It is also possible for there to be only air between the at least one coupling surface 32 and the base plate 3.

In these cases, the at least one coupling surface 32 is arranged at a distance from the base plate 3. The coupling surface 32 and the base plate 3 are capacitively coupled to one another.

It would also be possible for the at least one coupling surface 32 to be galvanically connected to the base plate 3. In order to facilitate a connection of this kind, it would be possible for a groove to be made in the base plate 3, the shape of which groove corresponds to the shape of the at least one coupling surface 32. The coupling frame 32 would be arranged at least in part in said groove.

The dimensions and the distance of the coupling surfaces 32 from the base plate 3 could be selected as desired. The coupling projection 31 is preferably thicker than the coupling surface 32.

The coupling projection 31 or coupling projections 31 is/are spaced further apart from the longitudinal axis 4 than the radiator surfaces 6, 12 of the first radiator and the second radiator 2, 11. The coupling projection 31 or coupling projections 31 extend outside of the receiving space of the second radiator 11 and outside of the receiving space 16 of the first radiator 2.

FIG. 4B is an enlarged view of a portion from FIG. 4A. This portion illustrates that the coupling surfaces 32 end at a distance from the base plate 3. This distance can be selected as desired depending on the desired coupling and size of the coupling surfaces 32. The distance can be selected for example so as to be smaller than 2 cm, 1.5 cm, 1 cm, or smaller than 0.5 cm, or so as to be greater than 0.3 cm, 0.7 cm, 0.9 cm, 1.3 cm or 1.7 cm.

FIG. 4B also shows that the covering hood 25 is arranged such that it is not in contact with the coupling projections 31 having the respective coupling surfaces 32.

FIG. 6 shows that each coupling projection 31 has its own coupling surface 32, the coupling surfaces 32 of each coupling projection 31 being arranged such that they are isolated and at a distance from one another. In FIG. 6, there are three coupling projections 31 each comprising one coupling surface 32. In this case, the coupling surface 32 can have any cross section, as has already been explained in relation to the coupling frame. In FIG. 6, the coupling surfaces 32 have a cross-sectional shape which includes the partially circular segments. In this case, the coupling surfaces 32 can be arranged in parallel with the base plate 3 or also obliquely to the base plate 3. The coupling projections 31 are preferably thicker than the coupling surfaces 32. The coupling projections 31 are connected by the second end 31*b* thereof to the coupling surfaces 32, preferably in the centre of said surfaces. All of the coupling surfaces 32 preferably have the same shape and/or size. It is also possible for the at least one or all of the coupling surfaces 32 to have a different shape and/or size. The individual coupling surfaces 32 do not have to be arranged symmetrically around the first radiator 2. This means that a distance between the individual coupling surfaces 32 can be different. The coupling surfaces 32 and the coupling projections 31 can be produced in one piece. They can also be interconnected by means of a solder or weld connection. The same also applies to the coupling projections 31 in respect of the second radiator 11. A distance between the coupling surfaces 32 and the first radiator 2 corresponds for example to the width of the coupling surfaces 32 in the radial direction proceeding from the longitudinal axis 4. However, the distance can also be longer or shorter than the width of the corresponding coupling surface 32.

Some coupling surfaces 32 can also be interconnected, whereas other coupling surfaces 32 are arranged individually.

The coupling surfaces 32 can also be produced in a cutting and/or stamping process.

FIGS. 7A, 7B, 7C, 8, 9A and 9B show another embodiment of the omnidirectional antenna 1. In this embodiment, the first radiator and second radiator 2, 11 are produced from a metal sheet together with the coupling projections 31 and the coupling surfaces 32. In this case, all of these elements are preferably produced by a cutting, stamping and/or bending process. In this case, the second radiator 11 is not arranged as a continuation of the first radiator 2 along the longitudinal axis 4 away from the base plate 3. Conversely, the at least one radiator surface 12 of the second radiator 11 is arranged in the region of the second end 2*b* of the first radiator 2, between the radiator surfaces 6 of the first radiator 2, so as to be in parallel with the base plate 3 or such that one of the components thereof is predominantly in parallel with said plate. In view of FIG. 7C, which is a sectional view of the omnidirectional antenna 1 in accordance with the second embodiment, the radiator surfaces 6 of the first radiator 2 terminate at the same distance from the base plate 3 as the radiator surfaces 12 of the second radiator 11. However, the radiator surfaces 12 of the second radiator 11 could also be arranged closer towards the base plate 3 than the second end 2*b* of the first radiator 2. They could also be arranged further away from the base plate 3 than the second end 2*b* of the first radiator 2.

The first radiator 2 preferably comprises n radiator surfaces 6, where n>2. In this case, the n radiator surfaces 6 are galvanically interconnected at the first end 2*a* of the first radiator 2 or are formed in one piece with one another or on one another. The radiator surfaces 6 are arranged around the longitudinal axis 4 of the first radiator 2 so as to be offset from one another, thus forming slots 40. The slots 40 begin at the first end 2*a* of the first radiator 2 and extend as far as the second end 2*b* of the first radiator 2. The slots 40 or each slot 40 or one slot 40 preferably has/have a larger surface area than one of the n radiator surfaces 6 of the first radiator 2.

Figure 7A:
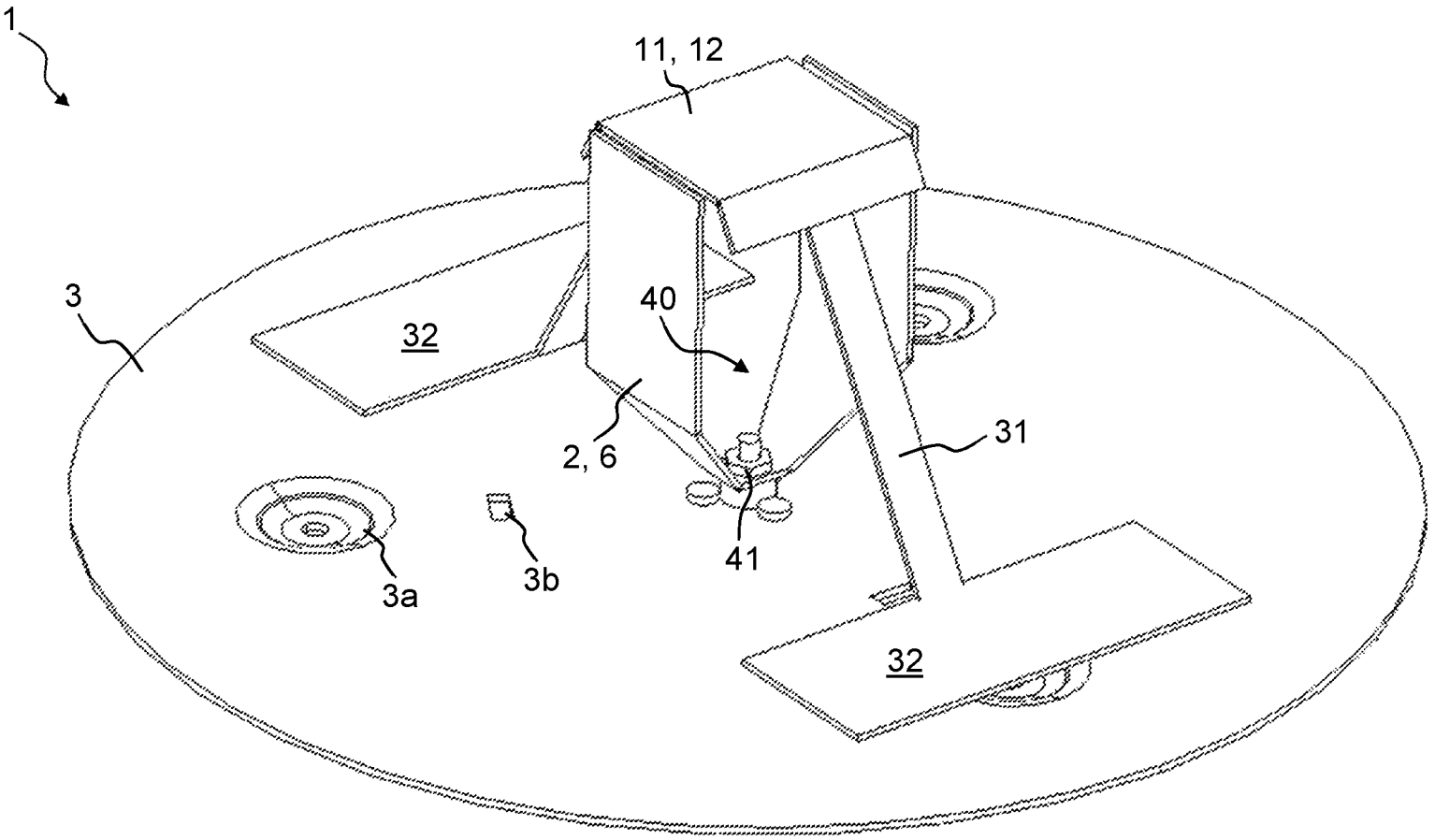
Figure 7B:
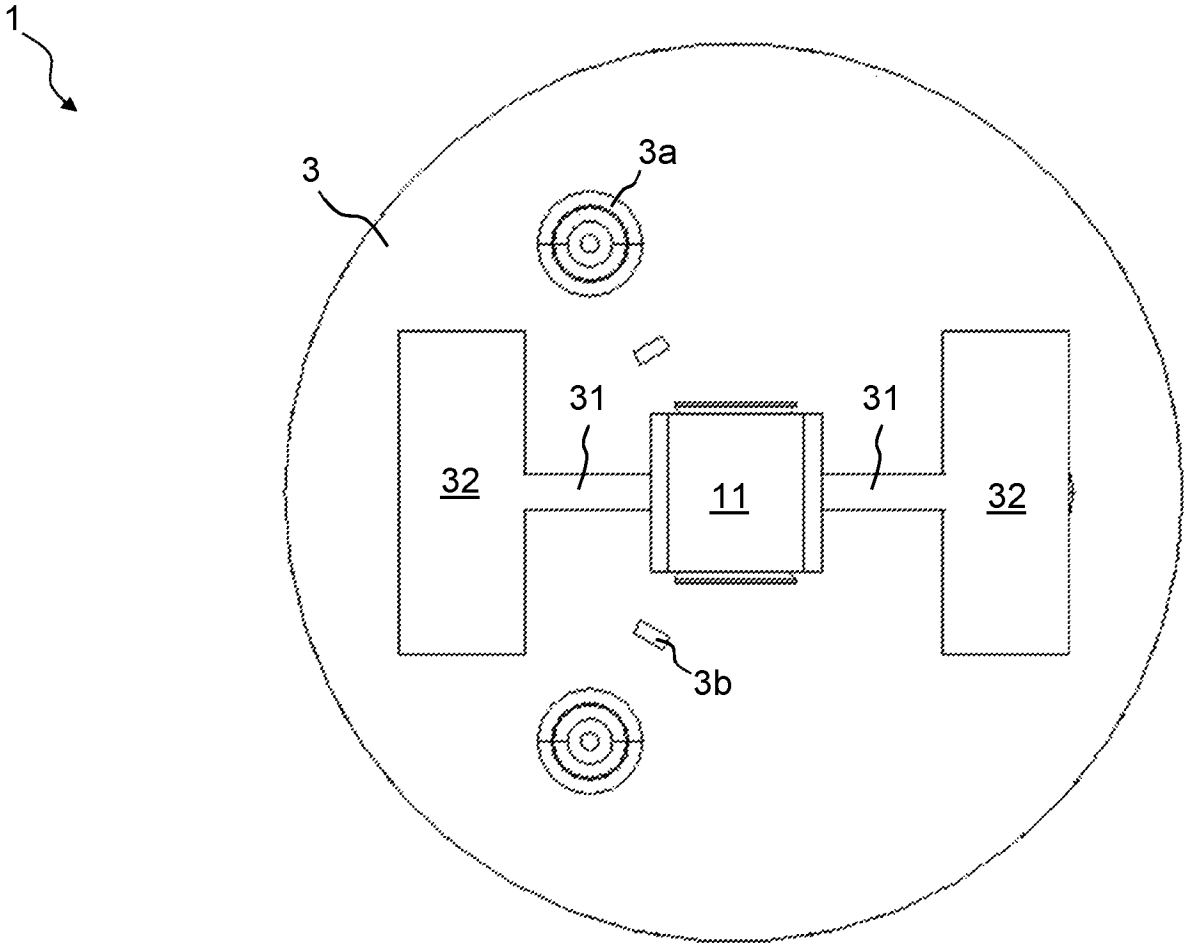
Figure 7C:
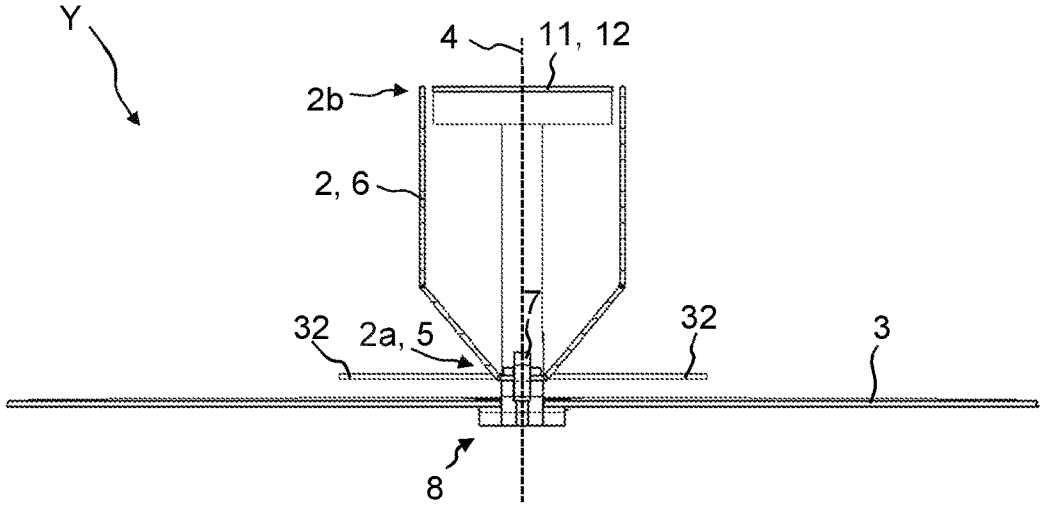

In FIG. 7A, the radiator surfaces 6 of the first radiator 2 comprise a plurality of radiator partial surfaces which are oriented at an angle to one another. In this case, the radiator partial surfaces not only extend from the base plate 3 along the longitudinal axis 4 or away from the base plate 3 at an angle to the longitudinal axis 4, but they preferably also widen in portions from the first end 2*a* towards the second end 2*b* of the first radiator 2. This widening does not have to occur over the entire length of the respective radiator surfaces 6. The widening can also occur over only a partial length. Some radiator partial surfaces extend at an angle to the longitudinal axis 4, whereas other radiator partial surfaces extend in parallel with the longitudinal axis 4 or predominantly in parallel with said axis by one of their components. In particular, the radiator partial surfaces that are arranged closer to the foot and/or feed-in point 5 extend at an angle to the longitudinal axis 4.

In this case, the individual radiator surfaces 6 of the first radiator 2 are preferably arranged opposite one another. This means that two radiator surfaces 6 are preferably opposite one another in each case. An even number of radiator surfaces 6 are preferably used. In this case, the first radiator 2 would comprise at least 2·n radiator surfaces, where n≥1.

At least part of the at least one radiator surface 12 of the second radiator 11 is arranged on the second end 2*b* of the first radiator 2, between the radiator surfaces 6 of the first radiator 2, so as to be in parallel with the base plate 3 or such that one of the components thereof is predominantly in parallel with said plate.

The radiator surfaces 12 of the second radiator 11 can project at least in part beyond the slots 40, which isolate the radiator surfaces 6 of the first radiator 2 from one another. The at least one radiator surface 12 of the second radiator 11 can also comprise a plurality of radiator partial surfaces which are oriented at an angle to one another. It is precisely these radiator partial surfaces of the second radiator 11, that are oriented at an angle to one another and at an angle to the longitudinal axis 4, which extend through the slot 40 between the radiator surfaces 6 of the first radiator 2.

All of the radiator surfaces 6 of the first radiator 2 and/or all of the radiator surfaces 12 of the second radiator 11 are preferably designed so as to be free of curves, and are arranged in a separate plane. The first radiator 2 and the second radiator 11 can preferably be produced from a metal sheet in a cutting, stamping and/or bending process.

In this embodiment of the omnidirectional antenna 1, said antenna likewise comprises a coupling device 30, which is connected to the second radiator 11. The coupling device 30 also comprises one or more coupling projections 31, a first end 31*a* of a coupling projection 31 or the coupling projections being galvanically connected to the radiator surface 12 of the second radiator 11 and extending towards the base plate 3. The first end 31*a* of the coupling projection 31 or coupling projections 31 is preferably galvanically connected to the radiator partial surface of the second radiator 11 that is inclined ($0° < \alpha < 90°$) in relation to the longitudinal axis 4. Coupling surfaces 32 are again arranged at a second end 31*b* of the coupling projections 31. In this embodiment, said surfaces are in the shape of a rectangle. In this case too, a common coupling frame 32 could again be used, which is galvanically connected to all of the second ends 31*b* of the coupling projections 31.

What is not shown is that this embodiment of the omnidirectional antenna 1 likewise has at least one dielectric holding and/or spacing element. Said element is preferably arranged within the first radiator 2 and is non-rotatably fastened thereto. Said holding and/or spacing element is in turn non-rotatably fastened to the second radiator 11, the holding and/or spacing element being designed such that a gap between the second end 2*b* of the first radiator 2 and the second radiator 11 has a specifiable width.

FIG. 8 shows that the first radiator 2 is galvanically connected to the feed device 7 at the foot and/or feed-in point 5. In this case, the feed device 7 preferably comprises an external thread which is screwed into an internal thread of the first radiator 2. The first radiator 2 can be rigidly mounted on the sleeve 9 by means of a nut 41.

Therefore, the first radiator 2 can no longer be removed. Additionally or alternatively, solder or weld connections could also be used.

FIGS. 9A and 9B show a more accurate construction of the first radiator and second radiator 2, 11, respectively, as another embodiment of the omnidirectional antenna.

FIG. 9A shows the first radiator 2 which consists of two radiator surfaces 6 which not only increase in width along the longitudinal axis 4, but also have different radiator partial segments which are oriented at an angle to one another. In this embodiment, the first radiator 2 consists of a common part together with the radiator surfaces 6 thereof.

The same also applies to the second radiator 11 in FIG. 9B. Said radiator likewise preferably consists of a single part. Said radiator 11 comprises, in addition to its radiator surface 12, the coupling projections 31 comprising the coupling surfaces 32. In this case, the number of coupling projections 31 can be kept at any number. Preferably, the number of coupling projections 31 that the second radiator 11 comprises is the same as the number of slots 40 that the first radiator 2 comprises. The second radiator 11 together with the coupling projections 31 and the coupling surfaces 32 are preferably produced from a single piece.

In this embodiment, the first radiator 2 has a V-shape. The second radiator 11 has a shape that is similar to an upside-down V.

The height of the omnidirectional antenna 1 along the longitudinal axis 4 corresponds to $0.18\lambda$, where $\lambda$ is in this case the wavelength of the lower limiting frequency (e.g. 694 MHz).

The invention is not limited to the embodiments described. Within the scope of the invention, all the features described and/or illustrated can be combined with one another as desired.

The invention claimed is:

1. A broadband omnidirectional antenna comprising:

a first radiator which is galvanically isolated from a base plate and extends away therefrom, the first radiator having a longitudinal axis which extends at least approximately perpendicularly to the base plate;

the first radiator having, along its longitudinal axis, a progression that is in part or predominantly or completely conical or funnel-shaped;

the first radiator having a first end comprising a foot and/or feed-in point and a second end which is opposite the first end;

the first end being arranged closer to the base plate than the second end;

the first radiator comprising radiator surfaces which originate in the region of the first end and extend towards the second end or form said second end;

a distance between the radiator surfaces and the longitudinal axis increasing at least in portions from the first end towards the second end;

a second radiator which comprises at least one radiator surface, the second radiator being arranged on the first radiator so as to be galvanically isolated therefrom and it being possible for said second radiator to be fed exclusively or predominantly by the first radiator;

the second radiator comprising a peripheral radiator surface having a diameter at a first end thereof adapted to a diameter of the second end of the first radiator;

the second radiator comprising one or more slots, which extend from a second end thereof opposite the first end, towards said first end and terminate at a distance therefrom;

wherein:

a) the at least one radiator surface of the second radiator is arranged as a continuation of the first radiator such that the at least one radiator surface is inclined at least in portions or is in parallel with the longitudinal axis; or b) the at least one radiator surface of the second radiator is arranged in the region of the second end of the first radiator, between the radiator surfaces of the first radiator, so as to be in parallel with the base plate or such that one of the components thereof is predominantly in parallel with said base plate.

2. The broadband omnidirectional antenna according to claim 1, further comprising:

a feed device arranged at the foot and/or feed-in point;

the feed device extending towards the base plate;

a connector element, in the form of a socket, arranged on a bottom side of the base plate, which side is opposite an assembly side comprising the first radiator and second radiator, it being possible to connect the connector element to a feed cable having an internal conductor;

wherein the feed device extends, at least by a first end thereof, into the connector element, it being possible for electrical contact to be established, at least indirectly, between the first end of the feed device and the internal conductor of the feed cable.

3. The broadband omnidirectional antenna according to claim 2, wherein:

the feed device is galvanically isolated from the base plate; and the feed device is:

a) galvanically, and in a solder-free manner, connected to the first radiator at the foot and/or feed-in point; or b) capacitively coupled to the first radiator at the foot and/or feed-in point, the feed device extending towards the second end of the radiator surfaces of the first radiator at least in part along the longitudinal axis.

4. The broadband omnidirectional antenna according to claim 3, wherein:

the foot and/or feed-in point of the first radiator has a sleeve-shaped extension towards the second end of the first radiator;

the feed device is arranged in the sleeve-shaped extension at least over a partial length thereof; and the feed device and the sleeve-shaped extension are galvanically isolated from one another.

5. The broadband omnidirectional antenna according to claim 1, wherein:

the diameter at the first end of the second radiator deviates from the diameter at the second end of the first radiator by less than 20%, as a result of which the first end of the second radiator is adapted to the second end of the first radiator.

6. The broadband omnidirectional antenna according to claim 1, wherein:

the diameter of the second radiator at the first end thereof is equal to or larger than the diameter of the first radiator at the second end thereof; and/or the diameter of the second radiator remains constant along the longitudinal axis or decreases in the direction of the longitudinal axis from the first end towards the second end; and/or the second radiator extends along the longitudinal axis over a longer length than the first radiator.

7. The broadband omnidirectional antenna according to claim 1, wherein:

said antenna further comprises a dielectric holding and/or spacing element;

the holding and/or spacing element being arranged within the first radiator and being non-rotatably fastened thereto;

the holding and/or spacing element being non-rotatably fastened to the second radiator, the holding and/or spacing element being designed such that a gap between the first end of the second radiator and the second end of the first radiator has a definable width.

8. The broadband omnidirectional antenna according to claim 7, wherein:

the holding and/or spacing element comprises a plurality of first clip connections;

the plurality of first clip connections engaging in a plurality of fastening openings in the first radiator;

the holding and/or spacing element comprising a plurality of second clip connections;

the plurality of second clip connections engaging a) in a plurality of fastening openings in the second radiator; or b) in the plurality of slots in the second radiator, as a result of which the holding and/or spacing element is non-rotatably connected to the first radiator and second radiator.

9. The broadband omnidirectional antenna according to claim 1, wherein:

the first radiator comprises n radiator surfaces, where $n \geq 2$;

the n radiator surfaces are galvanically interconnected or formed in one piece with one another at the first end of the first radiator, the radiator surfaces being arranged around the longitudinal axis of the first radiator so as to be offset from one another, thus forming slots between adjacent radiator surfaces, and the slots beginning at a distance from the first end of the first radiator and extending as far as the second end of the first radiator;

at least part of the at least one radiator surface of the second radiator is arranged on the second end of the first radiator, between the radiator surfaces of the first radiator, so as to be in parallel with the base plate or such that one of the components thereof is predominantly in parallel with said base plate.

10. The broadband omnidirectional antenna according to claim 9, wherein:

the radiator surfaces of the first radiator comprise a plurality of radiator partial surfaces which are oriented at an angle to one another; and/or the at least one radiator surface of the second radiator comprises a plurality of radiator partial surfaces which are oriented at an angle to one another.

11. The broadband omnidirectional antenna according to claim 9, wherein:

each radiator surface of the first radiator and/or second radiator or each radiator partial surface of a radiator surface of the first radiator and/or second radiator is designed so as to be free of curves and is arranged in a plane; and/or the first radiator and/or the second radiator can be produced from a metal sheet in a cutting, stamping and/or bending process.

12. The broadband omnidirectional antenna according to claim 9, wherein:

said antenna further comprises at least one dielectric holding and/or spacing element;

the holding and/or spacing element being arranged within the first radiator and non-rotatably fastened thereto;

the holding and/or spacing element being non-rotatably fastened to the second radiator, the holding and/or spacing element being designed such that a gap between the second end of the first radiator and the second radiator has a specifiable width.

13. A broadband omnidirectional antenna comprising:

a first radiator which is galvanically isolated from a base plate and extends away therefrom, the first radiator having a longitudinal axis which extends at least approximately perpendicularly to the base plate;

the first radiator having a first end comprising a foot and/or feed-in point and a second end which is opposite the first end;

the first end being arranged closer to the base plate than the second end;

the first radiator comprising radiator surfaces which originate in the region of the first end and extend towards the second end or form said second end;

a distance between the radiator surfaces and the longitudinal axis increasing at least in portions from the first end towards the second end;

a second radiator which comprises at least one radiator surface, the second radiator being arranged on the first radiator so as to be galvanically isolated therefrom and it being possible for said second radiator to be fed exclusively or predominantly by the first radiator;

wherein:

(a) the radiator surfaces of the second radiator are arranged as a continuation of the first radiator such that they are inclined at least in portions or are in parallel with the longitudinal axis; or (b) the at least one radiator surface of the second radiator is arranged in the region of the second end of the first radiator, between the radiator surfaces of the first radiator, so as to be in parallel with the base plate or such that one of the components thereof is predominantly in parallel with said base plate; and said antenna comprises a coupling device comprising one or more coupling projections, a first end of the coupling projection or coupling projections being galvanically connected to the radiator surface of the second radiator and extending towards the base plate;

the coupling projection or coupling projections being spaced further apart from the longitudinal axis than the radiator surfaces of the first radiator and second radiator;

at least one coupling surface formed or integrally formed on a second end of the coupling projection or coupling projections that is opposite the first end and is arranged closer to the base plate than said first end, which coupling surface is galvanically connected to the relevant coupling projection; and the at least one coupling surface extending in parallel with the base plate or such that one of the components thereof is predominantly in parallel with said base plate.

14. The broadband omnidirectional antenna according to claim 13, wherein:

the at least one coupling surface is galvanically connected to the base plate or is arranged at a distance therefrom such that the at least one coupling surface is capacitively coupled to the base plate.

15. The broadband omnidirectional antenna according to claim 14, wherein:

a dielectric is arranged between the at least one coupling surface and the base plate, on which dielectric the at least one coupling surface rests or is supported.

16. The broadband omnidirectional antenna according to claim 13, wherein:

the plurality of coupling projections are galvanically connected to a common coupling surface by the second end thereof, the coupling surface being in the form of a common coupling frame which defines a receiving space in which part of the first radiator is arranged;

the common coupling frame has a cross section which is in the shape of or is approximately:

a) a rectangle; or b) a square; or c) a circle; or d) an oval; or e) an n-polygon.

17. The broadband omnidirectional antenna according to claim 13, wherein:

the coupling projection or coupling projections extend at an angle to the longitudinal axis of the first radiator; and/or the coupling projection or coupling projections is/are formed in one piece with the second radiator or is/are fastened to the radiator as separate parts; and/or the at least one coupling surface is formed in one piece with the relevant coupling projection or is fastened thereto as a separate part.

18. The broadband omnidirectional antenna according to claim 13, wherein:

the coupling projection or coupling projections are guided through the slot or slots between two radiator surfaces of the first radiator.

19. The broadband omnidirectional antenna according to claim 13, wherein:

said antenna comprises just one covering hood;

the covering hood is connected to the base plate in an interlocking and/or frictional and also moisture-tight manner and surrounds the first radiator and the second radiator; and the covering hood is arranged such that it is not in contact with the first radiator and the second radiator.

20. The broadband omnidirectional antenna according to claim 1, wherein:

said antenna comprises just one covering hood;

the covering hood is connected to the base plate in an interlocking and/or frictional and also moisture-tight manner and surrounds the first radiator and the second radiator; and the covering hood is arranged such that it is not in contact with the first radiator and the second radiator.

21. The broadband omnidirectional antenna according to claim 1, wherein:

said antenna comprises a coupling device comprising one or more coupling projections, a first end of the coupling projection or coupling projections being galvanically connected to the radiator surface of the second radiator and extending towards the base plate;

the coupling projection or coupling projections being spaced further apart from the longitudinal axis than the radiator surfaces of the first radiator and second radiator;

at least one coupling surface formed or integrally formed on a second end of the coupling projection or coupling projections that is opposite the first end and is arranged closer to the base plate than said first end, which coupling surface is galvanically connected to the relevant coupling projection; and the at least one coupling surface extending in parallel with the base plate or such that one of the components thereof is predominantly in parallel with said base plate.

* * * * *